US005390835A

United States Patent [19]

Murphy et al.

[11] Patent Number: 5,390,835

[45] Date of Patent: Feb. 21, 1995

[54] COVER FOR GARMENT A HANGER

[75] Inventors: William L. Murphy, Hinsdale; Robert Gorecki, Downers Grove, both of Ill.

[73] Assignee: Reliable Packaging, Inc., Chicago, Ill.

[21] Appl. No.: 204,620

[22] Filed: Mar. 1, 1994

[51] Int. Cl.[6] ..... A47G 25/14

[52] U.S. Cl. ..... 223/98; 223/87

[58] Field of Search ..... 223/98, 87, 84, 37; 206/300, 292, 295, 299

[56] References Cited

U.S. PATENT DOCUMENTS 1,715,004 5/1929 Johnson .
2,434,461 1/1948 Forcheimer .
2,873,054 2/1959 Zintel .
3,033,430 5/1962 Zintel .
3,117,706 1/1964 Kestner .
3,145,888 8/1964 Tillery ..... 223/87
3,202,330 8/1965 Hawkins .
3,363,812 1/1968 Hawkins ..... 223/98
4,944,436 7/1990 Moen et al. ..... 223/98
4,988,022 1/1991 Seitz .
5,139,184 8/1992 Seitz .

*Primary Examiner*—Clifford D. Crowder
*Assistant Examiner*—Bibhu Mohanty
*Attorney, Agent, or Firm*—Varnum, Riddering, Schmidt & Howlett

[57] ABSTRACT

A cover for a garment hanger and comprising opposed first and second arms, which are foldable about an axis. In the folded position, the first and second arms are in a coterminously overlying relationship to minimize the area occupied by the folded cover. In the unfolded position, the top of the cover forms a ridge and the sides of the shoulder guard extend outwardly away from the hanger for supporting the garment draped over the cover in a natural position to reduce hanger marks and creases.

8 Claims, 3 Drawing Sheets

COVER FOR GARMENT A HANGER

BACKGROUND OF THE INVENTION

FIELD OF THE INVENTION

This invention relates to a cover for use with garment hangers, and, more specifically, to an assembled cover which is foldable for easy use, shipping and handling while protecting a garment draped on the hanger from hanger marks and creasing.

DESCRIPTION OF RELATED ART

The use of wire hangers for hanging clothing is commonplace in the dry-cleaning and garment manufacturing industries. A typical wire hanger comprises a single length of wire which is bent into a generally triangular base having a hook portion extending upwardly from the base. Typically, the triangular base comprises downwardly angled opposed arms which have proximal ends at the hook portion and are connected at their distal ends by a transverse portion.

Unfortunately, the use of a wire hanger for mounting a garment often results in the garment developing hanger marks from direct contact with the hanger and crease lines where the garment drapes on the arms of the hanger because of the sharp edges created by the relative thinness of the wire used to construct the wire hanger. Further, the bent ends of the wire hanger often cause creases near the garment's shoulders.

Therefore, it has long been known to provide the wire hanger with a cover to prevent direct contact between the garment and the hanger to reduce hanger marks. It is also desirable for the cover to create a surface that is much wider and more rounded than the hanger to prevent creasing of the garment from the sharp edges of the wire hanger. The shape of the cover preferably simulates the shape of the general shoulder area of a human torso so the garment draped over the cover will have a more natural appearance when removed from the hanger. To this end, the sides of the cover are preferably directed outwardly, away from the hanger.

Generally, covers for hangers are sold, packaged and shipped in very large quantities. A minor reduction in the size of the packaging can result in significant cost savings. Therefore, it is desirable to reduce the area occupied by the covers to reduce the associated packaging and shipping cost.

Previous covers have addressed one or more of the problems associated with the use of wire hangers and covers for wire hangers. However, all of the previous covers have one or more undesirable characteristics. Some covers, such as is disclosed in U.S. Pat. No. 1,715,004, issued May 28, 1929, were directed solely to protecting the garment from contacting the hanger and did not address any of the other problems associated with hanger covers. Other covers, such as U.S. Pat. No. 2,434,461, issued Jan. 13, 1948, addressed only the problem of providing a surface rounded and made wider to eliminate creasing.

More recent covers attempt to provide a wider and more rounded surface along with sides that extended away from the hanger for maintaining a more natural shape for the garment mounted on the hanger. These covers comprise a one-piece card stock having a slot extending from one end to a central aperture through which the hook portion of the hanger passes. The slot is closed by a slot and tongue fastener to secure the hanger. These covers require a great amount of assembly time by the user because of the slot-and-tongue fastener. See in this regard U.S. Pat. Nos. 2,873,054, issued Feb. 10, 1959, 3,033,430, issued May 8, 1962 and 3,202,330, issued Aug. 24, 1965. It is known to replace the slot and tongue fastener with an adhesive. See in this regard, for example, U.S. Pat. No. 3,117,706, issued Jan. 14, 1964 and U.S. Pat. No. 4,988,022, issued Jan. 29, 1991. However, these covers are either relatively large or unnecessarily complex and increase the manufacturing and shipping costs.

One very recent cover is directed to simplifying the use and shipping of the covers while preventing hanger marks and creasing. Specifically, U.S. Pat. No. 5,139,184, issued Aug. 18, 1992, discloses a cover collapsible from an elongated orientation wherein the arms are separated by an obtuse angle to a V-shaped orientation in which the arms are separated by an acute angle to reduce the area occupied by the cover. Although the cover is acceptable, it unnecessarily occupies too much area when folded and increases the packaging and shipping cost.

SUMMARY OF INVENTION

The invention is a cover for a garment hanger to prevent hanger marks and creasing to a garment draped on the hanger. The cover is used on a hanger comprising a hook and opposed arms extending from the hook to support a garment. The cover comprises a blank having an upper surface and a lower surface and a perimeter defined by a top edge, a bottom edge, and opposed side edges. The opposed side edges connect the top and bottom edges. Preferably, an aperture is centrally disposed on the blank. The aperture receives the hook of the garment hanger. A first fold line extends from the bottom edge of the blank to the aperture. A slot extends from the aperture to the top edge and is aligned with the first fold line. The first fold line and the slot define a folding axis, which divides the blank into opposed first and second arms. The arms are generally symmetrical with respect to the folding axis. A second fold line is formed in the first arm and extends from the folding axis to the top edge of the cover to define a first arm flap portion of the cover, which is disposed between the second fold line and the slot. A third fold line is formed in the second arm and extends from the folding axis to the top edge to define a second arm flap portion of the cover, which is disposed between the third fold line and the slot. The first arm flap and the second arm flap are oriented so that when the blank is folded about the folding axis, the first arm flap overlies the second arm flap and the first arm coterminously overlies the second arm. Means are provided for securing the first arm flap to the second arm flap.

Preferably, the securing means is adapted to attach to the upper surface of one of the first or second arm flaps to the other of the first or second arm flaps. Second securing means is also provided for attaching the lower surface of one of the first and second arm flaps to the lower surface of the other of the first and second arm flaps. Preferably, the securing means is an adhesive.

In another aspect, the cover has first and second sawtooth-shaped slots. Each of the sawtooth-shaped slots extend from the aperture toward one of the proposed side edges. A first and second pair of divergent slits are disposed on the upper surface of the cover. One pair of divergent slits extends from one of the sawtooth-shaped slots toward one of the opposed side edges and the other pair of divergent slits extends from the other sawtooth-shaped slots toward the other opposed side edge. A first and second pair of score lines are formed in the upper surface of the cover. One pair of the score lines extends from one pair of the first or second pair of slits. The other pair of score lines extends from the other pair of slits. Preferably, the first sawtooth-shaped slot, the first pair of diverging slits and the first pair of score lines cooperate to define a first ridge. Likewise, the second sawtooth-shaped slot, the second pair of diverging slits and the second pair of score lines cooperate to define a second ridge. The first and second ridges provide support for a garment when the cover is mounted on the garment hanger.

BRIEF DESCRIPTION OF THE DRAWINGS

The invention will now be described with reference to the drawings wherein.

DESCRIPTION OF THE PREFERRED EMBODIMENTS

Figure 1:
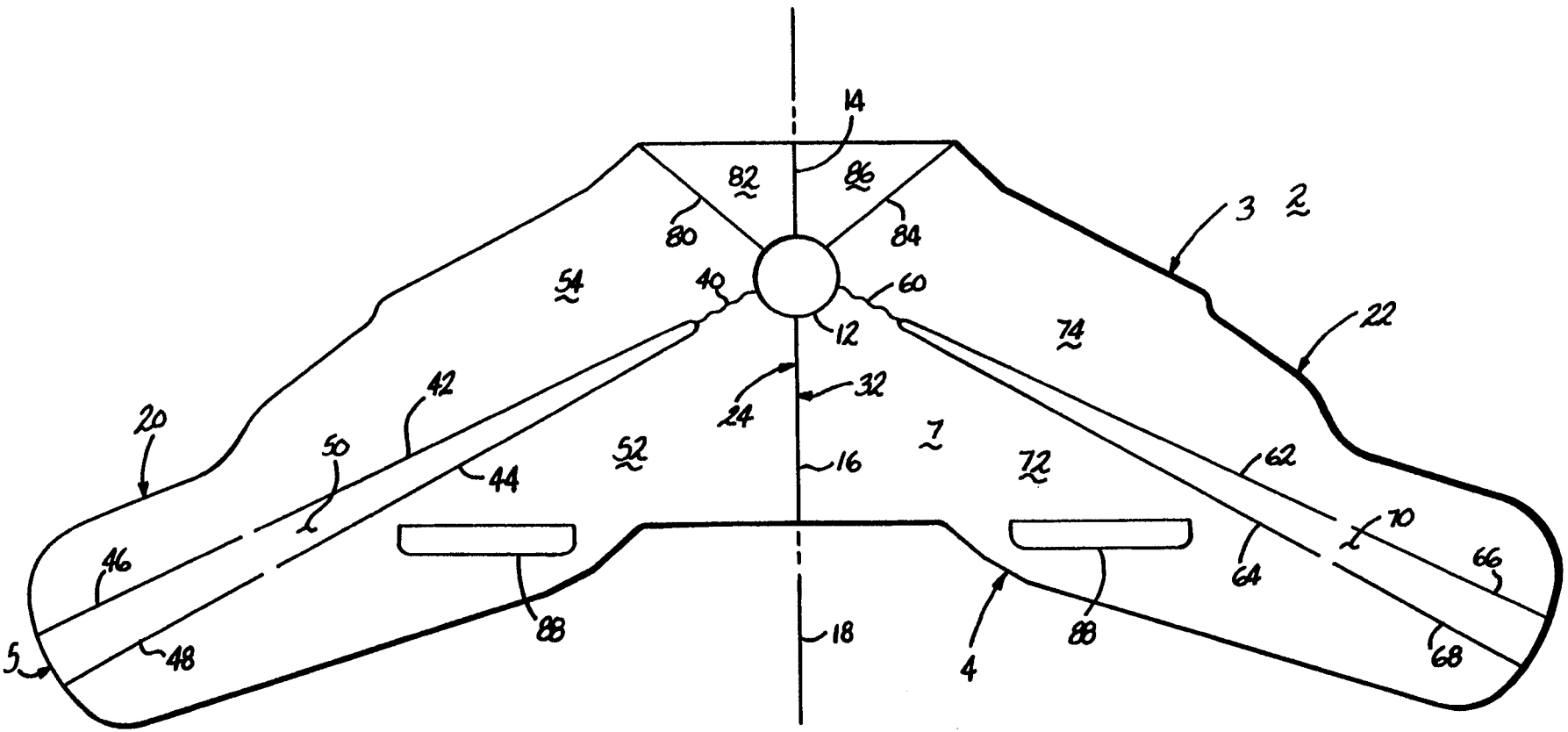
FIG. 1 is a plan view of a garment hanger cover according to the invention.
Figure 3:
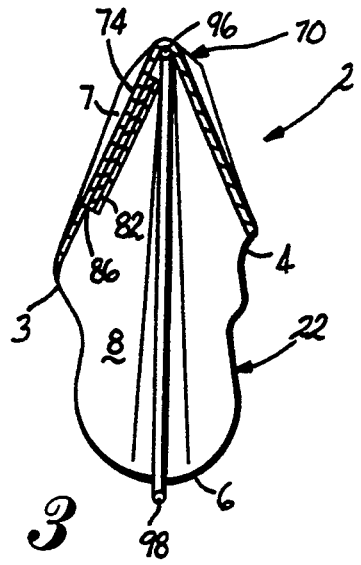
FIG. 3 is a sectional view taken along the line 3—3 of FIG. 2.

FIG. 1 illustrates a garment hanger cover 2 according to the invention. The cover 2 is formed from a foldable sheet, such as paper stock, and is defined by a top edge 3, a bottom edge 4, opposed side edges 5 and 6, upper surface 7 and lower surface 8 (FIG. 3). The cover 2 has a centrally disposed aperture 12 from which extends a slot 14 passing through the upper and lower surfaces 7, 8 and terminating at the top edge 3. A first fold line 16 on the upper surface 7 extends from the aperture 12, terminating at the bottom edge 4. The slot 14 and first fold line 16 define a folding axis 18, which divides the cover 2 into opposed first and second arms 20 and 22.

The opposed first and second arms 20 and 22 are mirror images of each other and are symmetrical with respect to the folding axis 18. The first arm 20 is defined by a proximal end 24 extending along the folding axis 18, top edge 3, bottom edge 4 and side edge 5. The proximal end 24 is defined by the first fold line 16, the aperture 12 and slot 14. Likewise, the second arm 22 is defined by a proximal end 32 extending along the folding axis 18, top edge 3, bottom edge 4 and side edge 6. The proximal end of the second arm 32 is defined by the first fold line 16, aperture 12 and slot 14.

The first arm 20 has a saw tooth perforation 40 passing through the upper and lower surfaces 7, 8 and extending from the aperture 12 toward the side edge 5. The saw tooth perforation 40 terminates at the origin of two diverging partial slits 42 and 44, extending from the saw-tooth perforation toward the side edge 5. The slits 42 and 44 partially extend through the upper surface 7 of the cover 2. The diverging partial slits 42 and 44 terminate near the side edge 5. A first pair of diverging score lines comprising score lines 46 and 48 extend from the partial slits 42 and 44 to the side edge 5 of the first opposed arm 20. The saw tooth perforation 40, partial slits 42, 44 and score lines 46, 48 define an arm ridge 50 for supporting a garment and separates the first opposed arm 20 into a front side 52 and a back side 54. Likewise, the second opposed arm 22 comprises a saw tooth perforation 60, partial slits 62, 64, a second pair of score lines comprising score lines 66, 68, which define arm ridge 70, dividing the second arm into front and back sides 72, 74.

First opposed arm 20 has a second fold line 80 extending from the folding axis 18 or aperture 12 to the top edge 3. The second fold line 80 and the slot 14 define a first arm flap 82 on a portion of the first opposed arm 20. The second opposed arm 22 has a third fold line extending from folding axis 18 to aperture 12 to the top edge 3. The third fold line 84 and the slot 14 define a second arm flap 86 on a portion of the second arm 22.

The cover 2 can optionally have auxiliary slots 88 for receiving straps of a garment, a belt, a necktie or the like.

Figure 2:
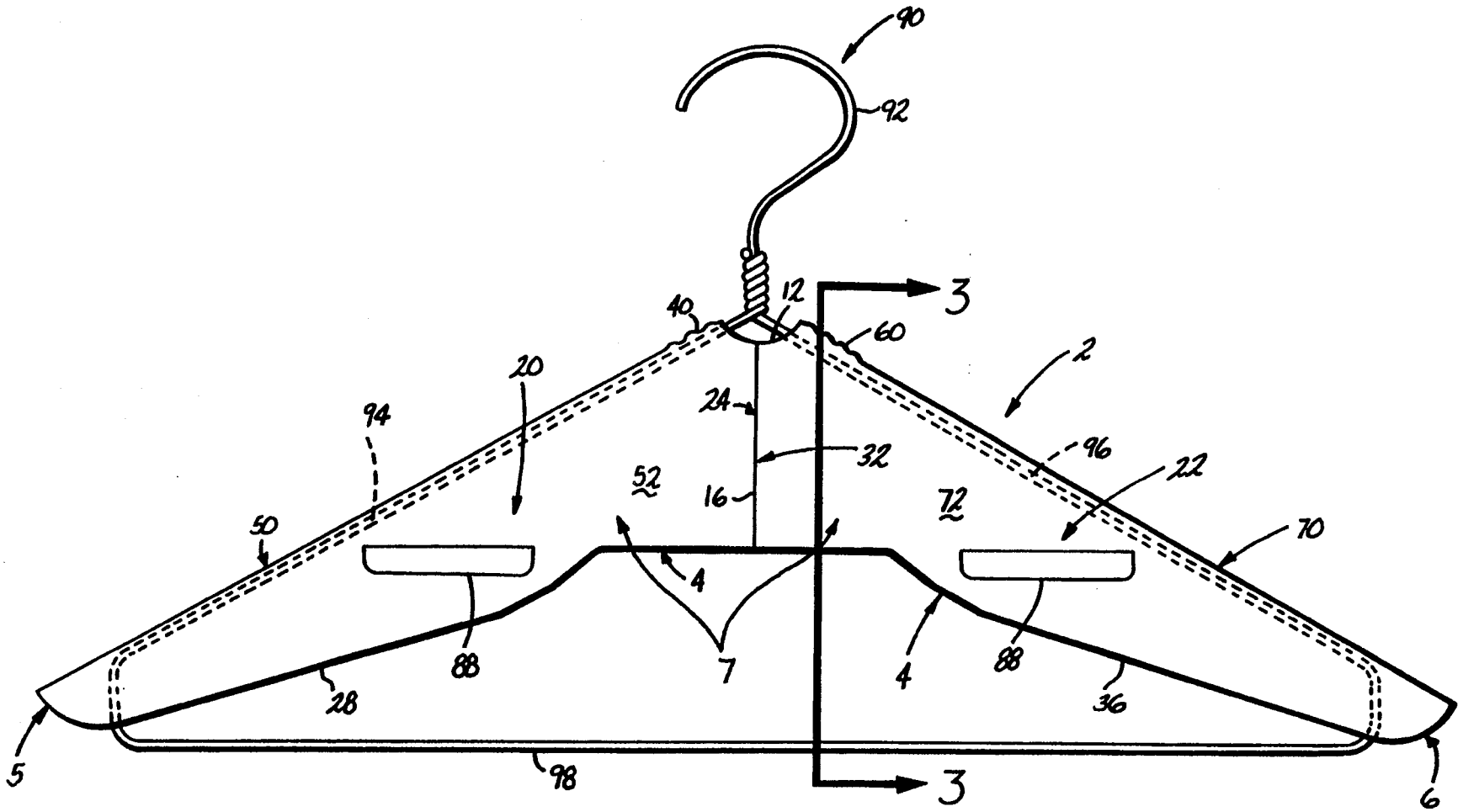
FIG. 2 is a side view of the garment hanger cover of FIG. 1 assembled and mounted on a hanger of the garment hanger cover of FIG. 1.
Figure 4:
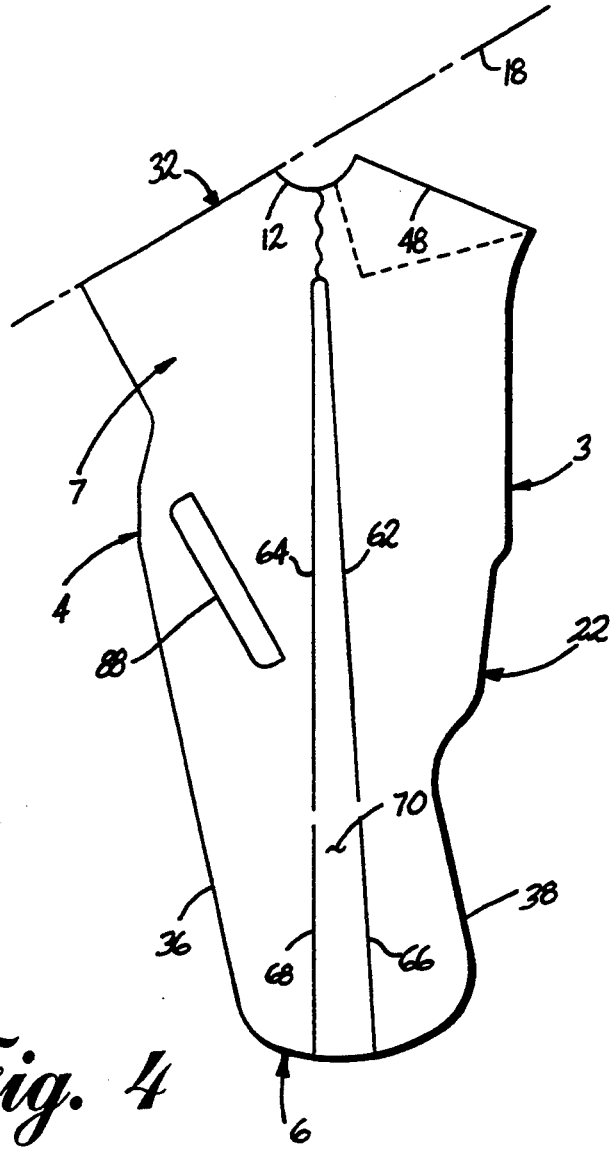
FIG. 4 is a plan view of the garment hanger cover of FIG. 1 in the folded position.

Referring to FIGS. 2–4, to assemble the garment hanger cover 2, an adhesive is applied to the portion of the lower surface 8 of the second arm flap 86. The second arm flap 86 is folded rearwardly approximately 180° along the third fold line 84 until the portion* of the lower surface 8 of the second arm flap 86 contacts the portion of the lower surface 8 of the second arm 22. The second arm flap 86 is held in this position while an adhesive is applied to the portion of the upper surface 7 of the second arm flap 86. The first arm flap 82 is folded rearwardly approximately 180° along the second fold line 80 so that the portion of the lower surface 8 of the first arm flap 82 is disposed against the portion of the lower surface 8 of the first arm 20. The first arm flap 82 is held in this position while the first arm 20 is folded approximately 180° along the first fold line about folding axis 18 to overly the second arm 22 (FIG. 4). When the first arm 20 overlies the second arm 22, the first arm flap 82 overlies the second arm flap 86 and is bonded to the second arm flap 86 by the adhesive applied to the second arm flap 86. Thus, the first arm flap 82, through the second arm flap 86, is bonded to the underside of the second arm 22.

It should be noted that the cover can also be assembled by bonding the first arm flap 82 to the lower surface of the first arm .and bonding the second arm flap 86 to the first arm flap in a manner similar as described above for the second arm flap. Also, a mechanical fastener can be used in place of the adhesive as means for fastening the first or second arm flaps 82, 86 to the first or second arms 20, 22 or the first or second arm flaps 82, 86 to each other. It should also be noted that either the first arm 20, second arm 22 or both can be folded about the folding axis 18 so that the lower surface 8 portions of the first and second arms 20, 22 are in contact.

In the folded position, the first arm 20 and second arm 22 are in a coterminously overlying relationship to minimize the area occupied by the assembled and folded garment hanger cover 2. The minimal area occupied by the shoulder guard results in reduced shipping and handling costs.

To use the assembled and folded cover 2, a user removes the folded cover 2 from a suitable package and unfolds the cover 2 by rotating one or both of the first and second arms about the first fold line 16. As the garment hanger cover 2 is unfolded, the front sides 52, 72 and back sides 54, 74 of the first arm 20, and second arm 22, respectively, extend outwardly from the first arm ridge 50 and the second arm ridge 70 so that the garment draped over the shoulder guard will rest on the first and second arm ridges 50, 70 and be directed outwardly along the front sides 52, 72 and back sides 54, 74 to eliminate hanger marks and creases, while maintaining a more natural shape for the garment. The unfolded cover 2 is placed on a hanger 90 comprising a hook 92, opposed hanger arms 94, 96 and optional support member 98. The unfolded cover 2 is placed on a hanger 90 comprising a hook 92, opposed hanger arms 94, 96 and optional support member 98. The hook 92 of the hanger 90 is then inserted through the saw tooth perforations 40, 60 and aperture 12. The cover 2 is pushed down onto the hanger 90 until the first arm ridge 50 and the second arm ridge 70 contact the respective hanger arms 94, 96. Thus, the cover 2 is quick and easy to use from its folded and packaged position. More importantly, the cover folds to occupy the minimum amount of area with the arms in coterminous relationship.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A cover for a garment hanger comprising a hook and opposed arms extending from the hook for supporting a garment, the cover comprising a blank having:

an upper surface and a lower surface and a perimeter defined by a top edge, a bottom edge, and opposed side edges connecting the top edge and the bottom edge;

an aperture disposed centrally of the blank;

a first fold line extending from the bottom edge to the aperture;

a slot aligned with the first fold line and extending from the aperture to the top edge;

a folding axis defined by the first fold line and the slot, the folding axis dividing the blank into opposed first and second arms, the arms being generally symmetrical with respect to the folding axis;

a second fold line formed in the first arm and extending from the folding axis to the top edge to define a first arm flap portion of the cover disposed between the second fold line and the slot;

a third fold line formed in the second arm and extending from the folding axis to the top edge to define a second arm flap portion of the cover disposed between the third fold line and the slot, whereby when the blank is folded about the folding axis, the first arm flap overlies the second arm flap and the first arm coterminously overlies the second arm; and means for securing the first arm flap to the second arm flap.

2. The cover according to claim 1, wherein the securing means is adapted to attach the upper surface of one of the first and second arm flaps to the upper surface of the other of the first and second arm flaps.

3. The cover according to claim 2, further comprising second securing means for attaching the lower surface of one of the first and second arm flaps to the lower surface of the other of the first and second arm flaps.

4. The cover according to claim 1, wherein the securing means is an adhesive.

5. The cover according to claim 1, further comprising first and second sawtooth-shaped slots, the first sawtooth-shaped slot extending from the aperture toward one of the opposed side edges and the second sawtooth-shaped slot extending from the aperture to the other one of the opposed side edges.

6. The cover according to claim 5, further comprising first and second pairs of divergent slits on the upper surface of the cover, the first pair of slits extending from the first sawtooth-shaped slot toward one of the opposed side edges and the second pair of slits extending from the second sawtoothed-shaped slot to the other of the opposed side edges.

7. The cover according to claim 6, further comprising first and second pairs of score lines formed in the upper surface, one of the score lines of the first pair thereof extending from one of the slits of the first pair thereof to one of the opposed side edges, the other of the score lines of the first pair thereof extending from the other of the slits of the first pair thereof to said one side edge, one of the score lines of the second pair thereof extending from one of the slits of the second pair thereof to the other of the opposed side edges, the other of the score lines of the second pair thereof extending from the other one of the slits of the second pair thereof to said other side edge.

8. The cover according to claim 7, wherein the first sawtooth-shaped slot, the first pair of diverging slits and the first pair of score lines cooperate to define a first ridge, and the second sawtooth-shaped slot, the second pair of diverging slits and the second pair of score lines cooperate to define a second ridge, the first and second ridges being adapted to provide support for a garment when the cover is mounted on a garment hanger.

* * * * *